US007004465B2

(12) United States Patent
Keith

(10) Patent No.: US 7,004,465 B2
(45) Date of Patent: Feb. 28, 2006

(54) GAME TABLE

(76) Inventor: George A. Keith, 1191 Foxboro La., Bartlett, IL (US) 60103

( * ) Notice: Subject to any disclaimer, the term of this patent is extended or adjusted under 35 U.S.C. 154(b) by 0 days.

(21) Appl. No.: 10/741,894

(22) Filed: Dec. 19, 2003

(65) Prior Publication Data

US 2005/0133993 A1 Jun. 23, 2005

(51) Int. Cl.
*A63F 7/07* (2006.01)

(52) U.S. Cl. ..... 273/108; 273/108.5; 273/126 R; 273/126 A

(58) Field of Classification Search ... 273/108–108.57, 273/126 R–126 A; 473/415, 446; 62/66, 62/261

See application file for complete search history.

(56) References Cited

U.S. PATENT DOCUMENTS 469,249 A * 2/1892 Hoyt ..... 473/116
616,557 A * 12/1898 Phares ..... 473/116
2,587,855 A * 3/1952 Johnson ..... 62/66
3,391,933 A * 7/1968 Cooper ..... 273/108.56
3,636,725 A * 1/1972 MacCracken ..... 62/235
3,641,782 A * 2/1972 Timms ..... 62/177
3,730,603 A * 5/1973 Looms ..... 312/116
3,765,675 A * 10/1973 DiMarzio ..... 473/446
3,784,787 A * 1/1974 Shevlin ..... 219/386
4,189,928 A * 2/1980 Cerny ..... 62/66
4,242,012 A * 12/1980 Utt ..... 405/217
4,762,327 A * 8/1988 Gomez ..... 273/309
5,027,613 A * 7/1991 Pare ..... 62/235
5,074,556 A * 12/1991 Loeppky et al. ..... 273/108.5
6,612,127 B1 * 9/2003 Simmons ..... 62/457.2

* cited by examiner

*Primary Examiner*—Sebastiano Passaniti
(74) *Attorney, Agent, or Firm*—Michael Best & Friedrich LLP

(57) ABSTRACT

A game table for playing a game relating to an ice-related sport. The game table includes a tabletop substantially covered with a sheet of ice. Symbols printed on the tabletop are visible through the ice and relate to the sport of ice hockey, curling, skating, etc.

9 Claims, 4 Drawing Sheets

GAME TABLE

BACKGROUND

The present invention relates to games and particularly to game tables. More particularly, the present invention relates to game tables related to sports played on ice.

A game table is a piece of furniture shaped generally like a table, where the top provides a surface for playing a game. Conventional game tables include billiards, foosball, air hockey, etc. Some conventional game tables relate to sports played on ice. For example, one typical game table includes miniature hockey players that can be moved over a surface of a game table to hit a small puck and simulate the sport of ice hockey. In typical game tables relating to ice sports, and particularly to ice hockey, the table surface is constructed of a low-friction synthetic material over which a small plastic puck easily slides. Often, the material is a plastic or wood with a low-friction finish.

SUMMARY OF THE INVENTION

In conventional ice hockey game tables, the table surface is composed of a low-friction material to simulate the ice surface of a real hockey rink. However, the table surface is not really ice. A game table that is designed to simulate the play or feel of ice sports, and particularly the sport of ice hockey, more closely than conventional game tables would be welcomed by users of such game tables.

According to the present invention, a game table includes a top surface comprising ice.

BRIEF DESCRIPTION OF THE DRAWINGS

The detailed description refers to the accompanying figures in which.

DETAILED DESCRIPTION

Figure 1:
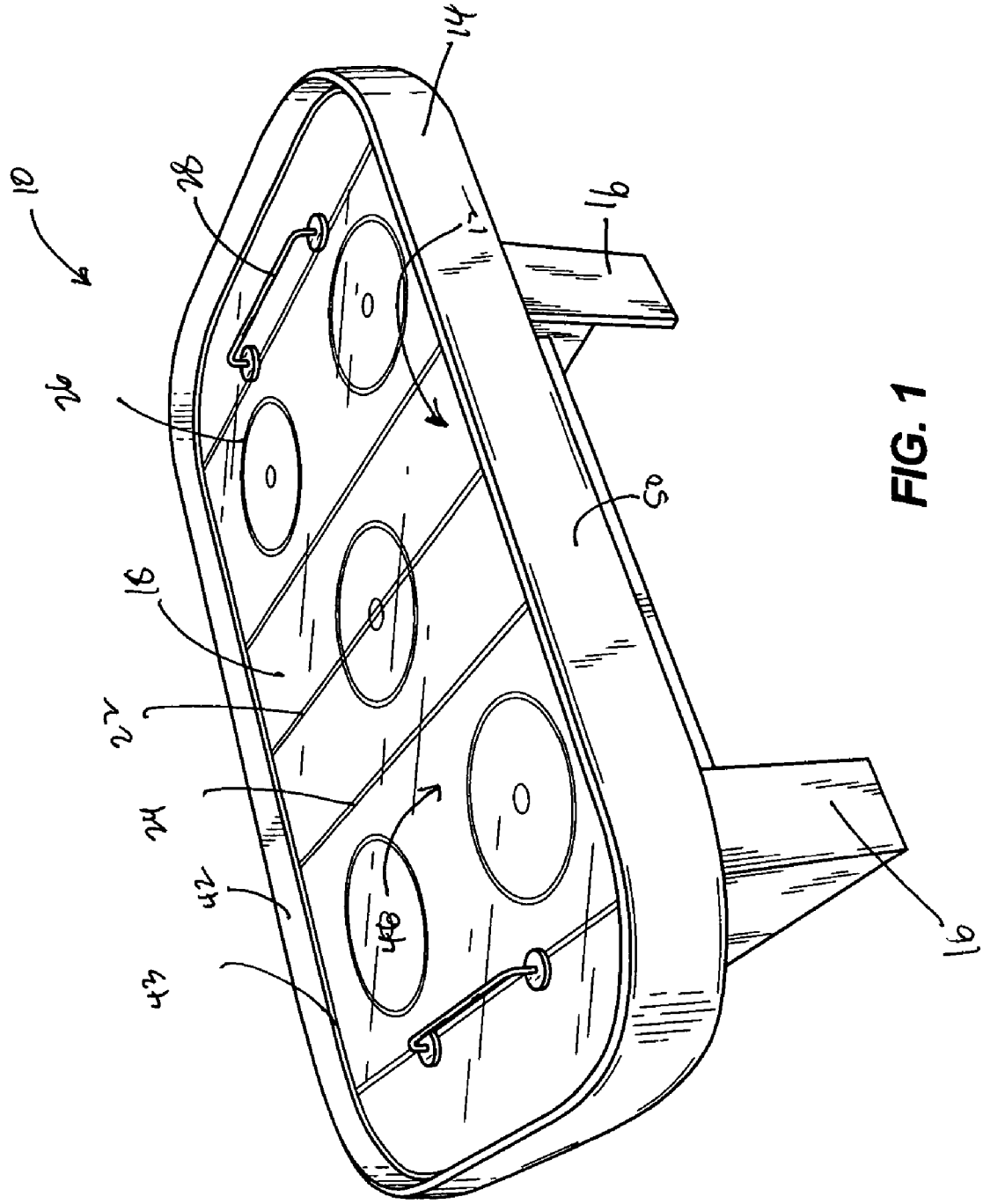
FIG. 1 is a perspective view of a game table according to the present invention.
Figure 2:
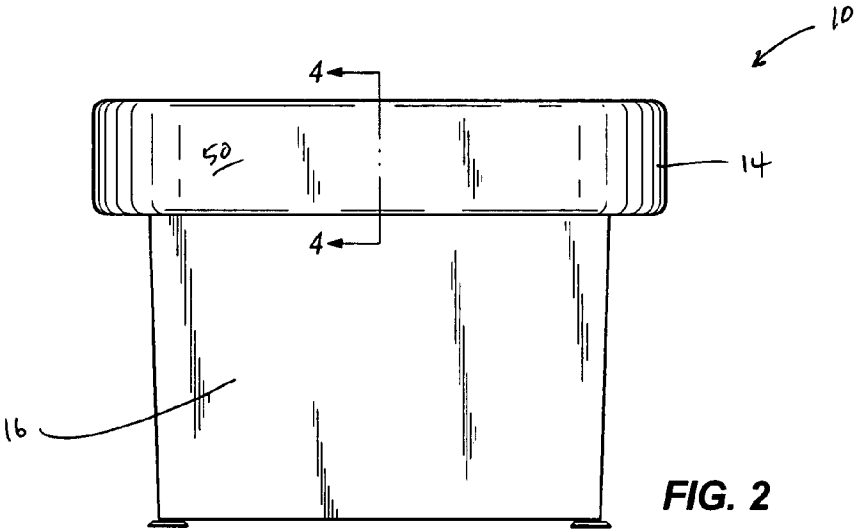
FIG. 2 is an end plan view of the game table of FIG. 1.
Figure 3:
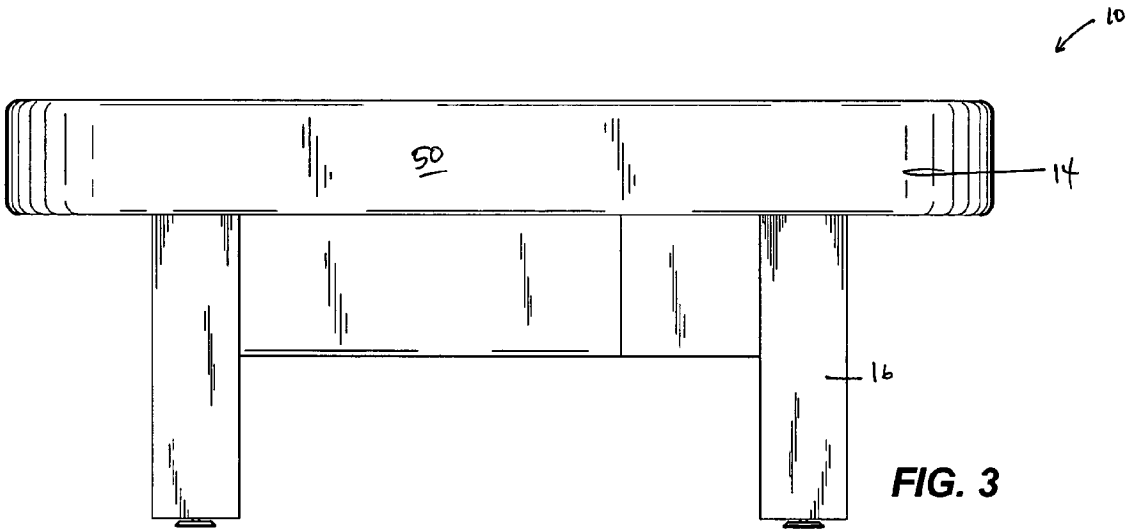
FIG. 3 is a side plan view of the game table of FIG. 1.

Referring to FIG. 1, a game table 10 according to the present invention includes a tabletop 12 substantially surrounded by a vertical wall 14 extending up from the tabletop 12 and supported on two legs 16. The tabletop 12 is covered by a sheet of ice 18 that is maintained by a cooling system 20 (see FIG. 5) within the table 10, as will be more fully described below. The tabletop 12 includes symbols or markings relating to the sport of ice hockey. For example, referring to FIG. 1, the tabletop 12 includes a red centerline 22, blue lines 24, and face-off circles 26. Further, two goals 28, one at each end, project upwardly from the tabletop 12. The tabletop 12, wall 14, and goals 28 are designed to represent similar structure found in the sport of ice hockey. However, the game table 10, and particularly the symbols on the tabletop 12, could be designed to simulate similar structures in any of a number of sports played on ice, including ice hockey, curling, ice skating, etc.

Figure 4:
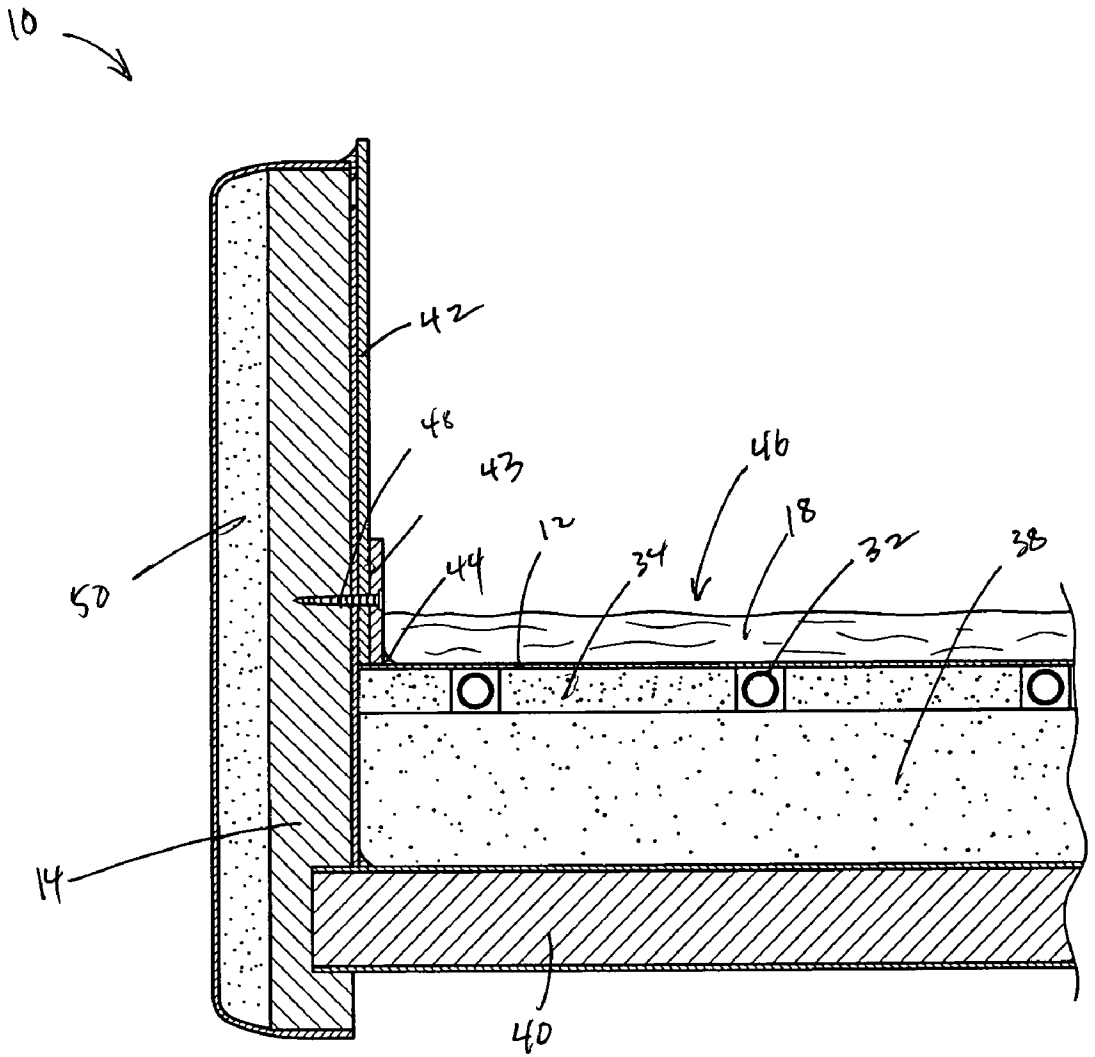
FIG. 4 is a cross section with portions broken away taken along line 4—4 of FIG. 2.
Figure 5:
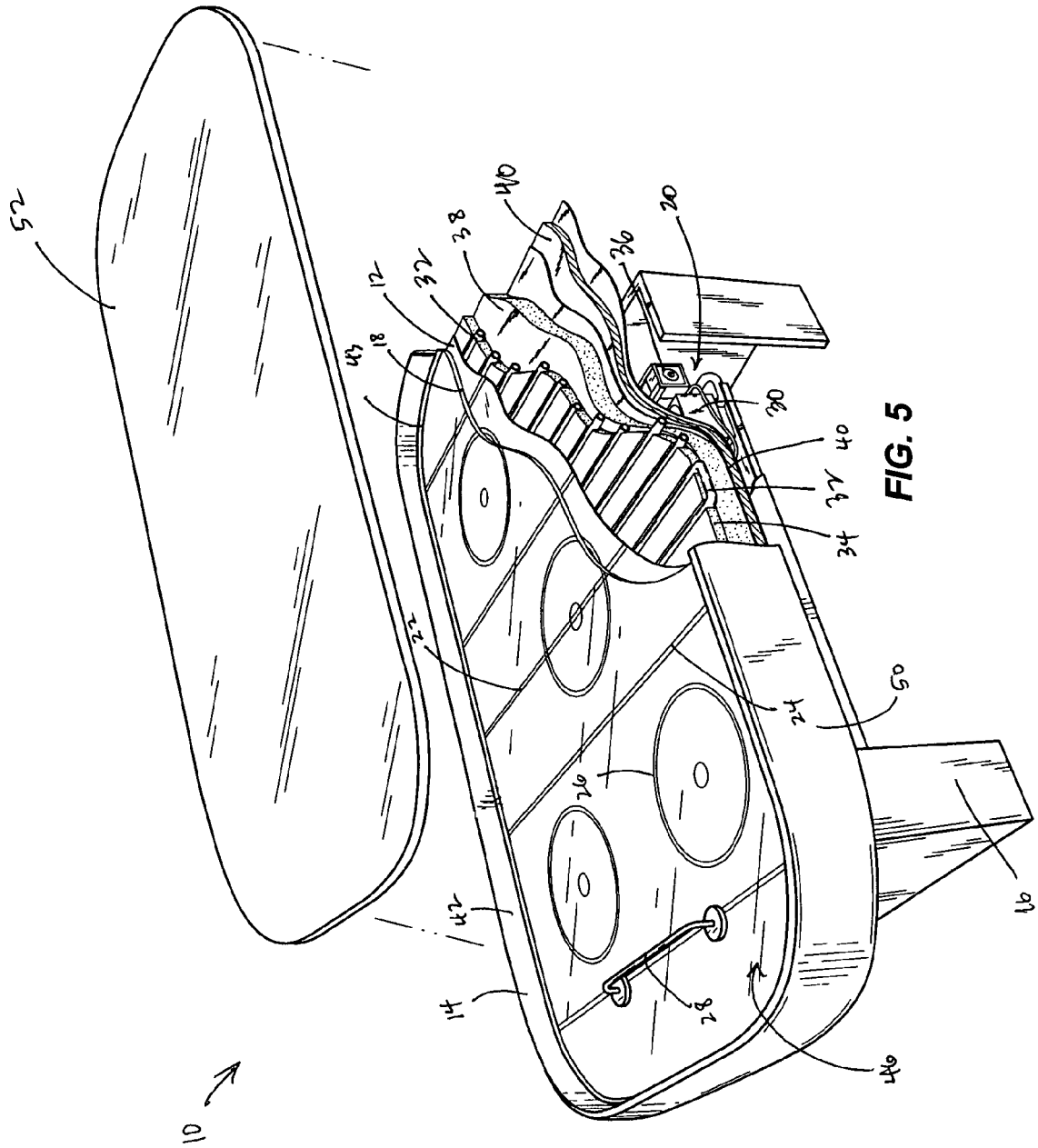
FIG. 5 is a partial exploded view of the game table of FIG. 1.

Referring to FIGS. 4 and 5, under the tabletop 12, the cooling system 20 maintains the ice on the tabletop 12. The cooling system 20 includes a compressor 30 that compresses a known refrigerant and circulates it through a refrigeration coil 32, a portion of which is positioned to lie in an insulated cooling layer 34 just beneath the tabletop 12. The cooling system 20, and particularly the refrigeration coil 32, keeps the tabletop 12 cool to maintain conditions above the tabletop 12 that are conducive to maintaining the sheet of ice 18. A user of the game table 10 controls the cooling system 20 at a thermostat 36. As best seen in FIG. 4, a layer of insulation 38 underlies the cooling layer 34 and is supported by a table bottom 40.

The tabletop 12 is formed of aluminum and is bounded on all sides by an inner wall 42 made of Lexan and having a base board 43 made of polyvinyl chloride (PVC). The inner wall 42 with its base board 43 is made to have the look and feel of the wall of a full-sized hockey rink. A bead of silicone 44 is positioned at the joint between the tabletop 12 and the base board 43 to create a watertight seal between the tabletop 12 and the base board 43. With the tabletop 12 formed of aluminum, the base board 43 formed of PVC, and the bead of silicone 44 sealing the joint therebetween, a watertight containment region 46 is formed on the tabletop 12, bounded by the base board 43. In this way, the watertight containment region 46 can be shallowly filled with water, which is then frozen using the cooling system 20. A depth of the water of ½ to ¾ inches has been found to be suitable, for example. It will be readily apparent to those of ordinary skill in the art, that, while the tabletop 12 is formed of aluminum and the base board 43 comprises PVC in the illustrated embodiment of the present invention, any substantially water-impermeable materials can be used within the spirit and scope of the present invention. Additionally, the base board 43 could be omitted and the water-impermeable seal could be created directly between the inner wall 42 and the tabletop 12.

As seen in FIG. 4, the inner wall 42 and base board 43 is screwed to the vertical wall 14. However, any means for adhering the inner wall 42 and base board 43 to the vertical wall 14 is within the spirit and scope of the present invention. If a fastener, such as the screw 48, is used to connect the inner wall 42 and base board 43 to the vertical wall 14, it should be positioned high enough on the inner wall 42 and base board 43 so that the top surface of the sheet of ice 18 is below it. If the screw 48, or other fastener, is positioned below the top surface of the sheet of ice 18, it should be sealed using silicone or some other material so that water cannot leak through the base board 43 and inner wall 42 at that location. As will be readily apparent to one of ordinary skill in the art, the inner wall 42 and base board 43 can also be adhered or connected in other ways to the vertical wall 14.

In the illustrated embodiment, the vertical wall 14 includes a layer of padding 50 that extends around the perimeter of the game table 10. In addition to softening the outer surface of the game table 10, the layer of padding 50 provides an additional layer of insulation, along with other insulation such as layer 38 and insulated cooling layer 34, to control the temperature of the watertight containment region 46. An insulated cover 52 (FIG. 5) can be utilized to further control the temperature of the region 46 when the table 10 is not in use.

In operation, a known refrigerant is compressed by the compressor 30 and circulated through the refrigeration coil 32. The refrigeration coil 32 extends back and forth underneath the tabletop 12 so that the refrigerant is distributed under substantially the entire tabletop 12 and cools the tabletop 12 and the water in the containment region 46. If the game table 10 were configured so that only certain portions of the tabletop 12 were to be cooled, the refrigeration coil 32 could be extended to distribute compressed refrigerant beneath only those areas. In the illustrated embodiment of the present invention, however, it is desired that the sheet of ice 18 cover substantially all of the tabletop 12. The water-tight containment region 46 is filled with a shallow layer of water that then freezes into ice in response to the cooled tabletop 12. With the tabletop 12 covered with the sheet of ice 18, any of a number of ice-related sports can be played in miniaturized form on the game table 10. In the illustrated embodiment of the present invention, the game table 10 is configured to mimic the sport of ice hockey. The goals 28, red centerline 22, blue lines 24, and face-off circles 26 all mimic the corresponding features of a full-size hockey rink.

With the sheet of ice 18 formed on the tabletop 12, miniature hockey sticks or other tools (not shown) can be used to slide a miniature puck (also not shown), or other such similar structure, over the surface of the sheet of ice 18. In other embodiments, the features of the game table 10, and particularly the symbols printed on it, could be configured differently to represent other sports commonly played on an ice surface. For example, the game table 10 could be configured, and the symbols printed on the tabletop 12 designed, to mimic the sport of curling. In such a case, miniature brooms and a miniature curling stone could be used on the sheet of ice 18 and different symbols representing the sport of curling could be printed on the tabletop 12. The entire game table 10 could also be configured in any of a number of various shapes corresponding to various sports. For example, the game table 10 could be oval shaped to represent a speed-skating track and a game involving the sport of speed skating could be played on the sheet of ice 18.

Although the invention has been described in detail with reference to certain described constructions, variations and modifications exist within the scope and spirit of the invention as described and defined in the following claims.

What is claimed is:

1. A game table comprising:

a tabletop;

a fixed wall extending above the tabletop, the wall having a top edge;

a support for elevating the tabletop;

a sheet of ice on the tabletop, the sheet of ice having a top surface below the top edge of the wall; and symbols on the tabletop and visible through the sheet of ice, the symbols relating to one of the games of ice hockey, curling, and skating, wherein the symbols in combination with the top surface of the ice define a playing surface for the game.

2. The game table of claim 1, further comprising a layer of insulation beneath the tabletop.

3. The game table of claim 2, further comprising a refrigeration coil embedded within the layer of insulation.

4. The game table of claim 1, further comprising a cooling system below the tabletop.

5. The game table of claim 4, wherein the cooling system includes a refrigeration coil, through which a compressed refrigerant flows.

6. The game table of claim 4, further comprising a layer of insulation beneath the tabletop.

7. A game table comprising:

a tabletop having a top side and a bottom side and supported substantially horizontally by a leg;

refrigeration tubing positioned adjacent the bottom side of the tabletop;

a condenser in fluid communication with the refrigeration tubing; and a fluid containment region on the top side of the tabletop; and symbols on the tabletop, the symbols relating to one of the games of ice hockey, curling, and skating.

8. The game table of claim 7, further comprising a sheet of ice supported by the top side of the tabletop.

9. A game table comprising:

a tabletop having a top side and a bottom side;

a refrigeration coil positioned adjacent the bottom side;

a sheet of ice supported by the top side;

a red line substantially bisecting the top side and visible through the sheet of ice;

two blue lines positioned substantially parallel to the red line and on opposite sides of the red line from each other, the blue lines being visible through the sheet of ice; and two goals supported by the top side and positioned substantially parallel to the blue lines, one each positioned at opposite ends of the top side and between a respective one of the blue lines and the respective end of the top side.

* * * * *